US005983151A

United States Patent [19]

Okada et al.

[11] Patent Number: 5,983,151

[45] Date of Patent: Nov. 9, 1999

[54] TRACTIVE FORCE CONTROL APPARATUS AND METHOD FOR CONSTRUCTION EQUIPMENT

[75] Inventors: Toshikazu Okada; Hidekazu Nagase; Shigeru Yamamoto, all of Hirakata; Noriaki Namiki, Kyoto; Nobuhisa Kamikawa, Hirakata, all of Japan

[73] Assignee: Komatsu Ltd., Tokyo, Japan

[21] Appl. No.: 08/849,182

[22] PCT Filed: Nov. 21, 1995

[86] PCT No.: PCT/JP95/02374

§ 371 Date: May 28, 1997

§ 102(e) Date: May 28, 1997

[87] PCT Pub. No.: WO96/17136

PCT Pub. Date: Jun. 6, 1996

[30] Foreign Application Priority Data

Nov. 28, 1994 [JP] Japan ..... 6-316049

[51] Int. Cl.[6] ..... E02F 3/85; E02F 9/22; F02D 29/04; F15B 11/00

[52] U.S. Cl. ..... 701/50; 172/2; 172/7

[58] Field of Search ..... 701/50; 172/2, 172/3, 7

[56] References Cited

U.S. PATENT DOCUMENTS

| | | | |
|---|---|---|---|
| 5,515,927 | 5/1996 | Matsushita et al. | 172/3 |
| 5,535,830 | 7/1996 | Matsushita et al. | 172/7 |
| 5,564,507 | 10/1996 | Matsushita et al. | 172/3 |
| 5,621,643 | 4/1997 | Nakagami et al. | 364/424.07 |
| 5,671,137 | 9/1997 | Ishino et al. | 364/424.09 |

FOREIGN PATENT DOCUMENTS

| | | |
|---|---|---|
| 59-97304 | 6/1984 | Japan . |
| 59-220535 | 12/1984 | Japan . |
| 2-14-6235 | 6/1990 | Japan . |
| 3-70885 | 3/1991 | Japan . |
| 7-208404 | 8/1995 | Japan . |

*Primary Examiner*—Michael J. Zanelli
*Attorney, Agent, or Firm*—Sidley & Austin

[57] ABSTRACT

A tractive force control apparatus and method for preventing a torque converter from being stalled while a working machine is operated during excavation and earth carrying work using a construction machine. In this apparatus, an engine rotational speed sensor (2), a torque converter output shaft rotational speed sensor (4) and a lift combination solenoid valve (12) are connected to a control apparatus. A pilot pressure control valve (11) for a blade lift is connected to a first lift operating valve (13), and also to a second lift operating valve (14) via the lift combination solenoid valve (12). First and second hydraulic pumps (20, 21) and lift cylinders (15, 15) are connected respectively via the first and second lift operating valves (13, 14). A traction output is computed in the control apparatus (16), and, when the traction output is lower than a target level, the lift combination solenoid valve (12) is turned off to reduce a flow rate of oil to the lift cylinders (15, 15). The traction force is thus increased correspondingly to prevent a torque converter (3) from being stalled.

21 Claims, 4 Drawing Sheets

TRACTIVE FORCE CONTROL APPARATUS AND METHOD FOR CONSTRUCTION EQUIPMENT

FIELD OF THE INVENTION

The present invention relates to a tractive force control apparatus and method for distributing an engine output of a construction equipment vehicle, especially a bulldozer, to a working machine system and a traveling system.

BACKGROUND ART

Generally, in a bulldozer, an engine drives a hydraulic pump and the bulldozer is operated to perform work by using the hydraulic power, while at the same time, a sprocket is driven via a torque converter, a transmission, and a final speed reducer to travel the bulldozer.

FIG. 4 is a hydraulic control circuit diagram for operating a blade of a conventional bulldozer; only a lift circuit for a blade 66 is shown, other control circuits being omitted.

A delivery circuit of a fixed-delivery hydraulic pump 60, driven by an engine 1, is connected to lift cylinders 63, 63 via a lift operating valve 61, which is equipped with an operating lever 62 for moving the blade 66 upwardly or downwardly. Reference numeral 64 denotes an oil tank.

The lift operating valve 61 shown in FIG. 4 is set to position (B) while not in operation and the blade 66 is in a stationary state.

When the lift operating valve 61 is set to position (A) by operating the operating lever 62, the respective lift cylinders 63, 63 are contracted, causing the blade 66 to move upwardly.

When the lift operating valve 61 is set to position (C), the respective lift cylinders 63, 63 are extended to push the blade 66 downwardly.

To perform excavation or earth carrying work, the blade 66 is pushed downwardly to excavate earth surface, while moving the blade upwardly and downwardly as the bulldozer is advanced; when the blade 66 is filled with earth, the blade 66 is placed in the stationary state, and the bulldozer is advanced to carry the earth.

The operating horsepower for the blade 66 is large; it reaches 40% of the engine horsepower when the hydraulic circuit of the working machine is in a relief state. The then actual horsepower supplied to the sprocket is approximately 30%.

Hence, as the load of the blade 66 increases, the horsepower supplied to the sprocket decreases, resulting in a drop in the vehicle speed. The operator senses the drop in the engine revolution or the drop in the vehicle speed, and lifts the blade 66 to reduce the load applied to the blade 66, thereby recovering the vehicle speed.

To solve the problem, the fixed-delivery hydraulic pump 60 shown in FIG. 4 has been replaced by a variable-delivery hydraulic pump 65 as shown in FIG. 5. Specifically, the load pressure at the respective lift cylinders 63, 63 of the blade 66 is detected and the delivery flow rate of the variable-delivery hydraulic pump 65 is controlled according to the detected load pressure so as to prevent wasteful oil from being discharged.

According to the configuration shown in FIG. 4, however, the full quantity of the fixed-delivery hydraulic pump 60 is always discharged while the blade 66 is being operated, consuming the horsepower. For instance, when shifting from a push-down excavation mode on a downhill to a push-up earth carrying mode on an uphill, if the lifting operation is implemented with the blade 66 filled with earth, then the operating horsepower of the blade 66 increases, causing a decrease in the engine output distributed to the traveling system. As a result, the vehicle speed drops and the speed of the engine 1 drops.

Further, if the blade 66 is excessively filled with earth and sand, then the apparent weight of the vehicle increases, causing the torque converter to be stalled. This results in an insufficient tractive output and the vehicle stops advancing.

On the other hand, according to the configuration shown in FIG. 5, the delivery flow rate of the variable-delivery hydraulic pump 65 is controlled to prevent wasteful oil from being discharged; however, consideration has not been given to increasing the engine output distributed to the traveling system so as to prevent the torque converter from being stalled.

SUMMARY OF THE INVENTION

The present invention has been made in view of the problems described above, and it is an object thereof to provide a tractive force control apparatus and method for a construction equipment vehicle, which apparatus and method minimize the chance of a torque converter being stalled even when a blade is lifted during excavation, earth carrying work, etc., so that sufficient tractive force is obtained and which enable prompt blade operation in a normal state.

According to a first aspect of the present invention, there is provided a tractive force control apparatus for a construction equipment vehicle, which apparatus splits and distributes the output of an engine to a working machine system for driving a plurality of hydraulic pumps to operate a working machine and a traveling system for driving a sprocket via a power line constituted by a torque converter, transmission, a final speed reducer, etc., to travel the vehicle; it is equipped with an engine rotational speed sensor for detecting the speed of the engine, a torque converter output shaft rotational speed sensor for detecting the speed of the output shaft of the torque converter, and a controller which compares the speed ratio e (=Nt/Ne), which is calculated from the engine rotational speed Ne detected by the engine rotational speed sensor and rotational speed Nt of the output shaft of the torque converter detected by the torque converter output shaft rotational speed sensor, with the target speed ratio ec, and if $$e \leqq ec,$$

then it controls a lift operating valve provided in the hydraulic circuit of the working machine system so that the discharge of one hydraulic pump is returned to an oil tank.

The controller is provided with a lift combination solenoid valve which is located between the controller and the lift operating valve; it switches the lift combination solenoid valve from ON to OFF to control the lift operating valve so as to return the discharge of the hydraulic pump 1 to the oil tank.

According to a second aspect of the present invention, there is provided a tractive force control method for a construction equipment vehicle, which method distributes the output of an engine to a working machine system for driving a plurality of hydraulic pumps to operate a working machine and a traveling system for driving a sprocket via a power line, constituted by a torque converter, transmission, a final speed reducer, etc., to travel the vehicle; if the tractive output of the traveling system is smaller than a predetermined target value, then the discharge of one hydraulic pump of the working machine system is returned to the oil tank to reduce the load on the working machine so as to increase the tractive output; if the tractive output is larger than the predetermined target value, then the return of the discharge of the hydraulic pump of the working machine system is stopped to permit prompt operation of the working machine.

Speed ratio e (=Nt/Ne), which is calculated from the engine rotational speed Ne and rotational speed Nt of the output shaft of the torque converter, is compared with the target speed ratio ec, and if $e \leqq ec$, then the lift operating valve provided in the hydraulic circuit of the working machine system is controlled to return the discharge of one hydraulic pump to the oil tank; or if $e > ec$, then the lift operating valve provided in the hydraulic circuit of the working machine system is controlled to stop the return of the discharge of the hydraulic pump.

The configuration and method described above make it possible to determine, at any time, the vehicular tractive output, distributed during travel, from the engine rotational speed and the torque converter output shaft speed. And when the tractive output falls below the predetermined target value, the load for driving the hydraulic pump of the working machine system is reduced to increase the engine output distributed to the traveling system, thereby preventing the torque converter from being stalled.

When the tractive output exceeds the predetermined target value, sufficient engine output is distributed to the working machine system to permit prompt operation of the working machine.

Thus, the actual tractive output is determined, and when the actual tractive output falls below the target tractive output, the speed ratio e is compared with the target speed ratio ec; if $e \leqq ec$, then the discharge of one hydraulic pump of the working machine system is returned to the oil tank; however, it is needless to describe that, depending on the value set for target speed ratio ec, the inequality becomes $e < ec$.

BEST MODE FOR CARRYING OUT THE INVENTION

Embodiments of a tractive force control apparatus and method for a construction equipment vehicle in accordance with the present invention will now be described in detail with reference to FIGS. 1 through 3.

Figure 1:
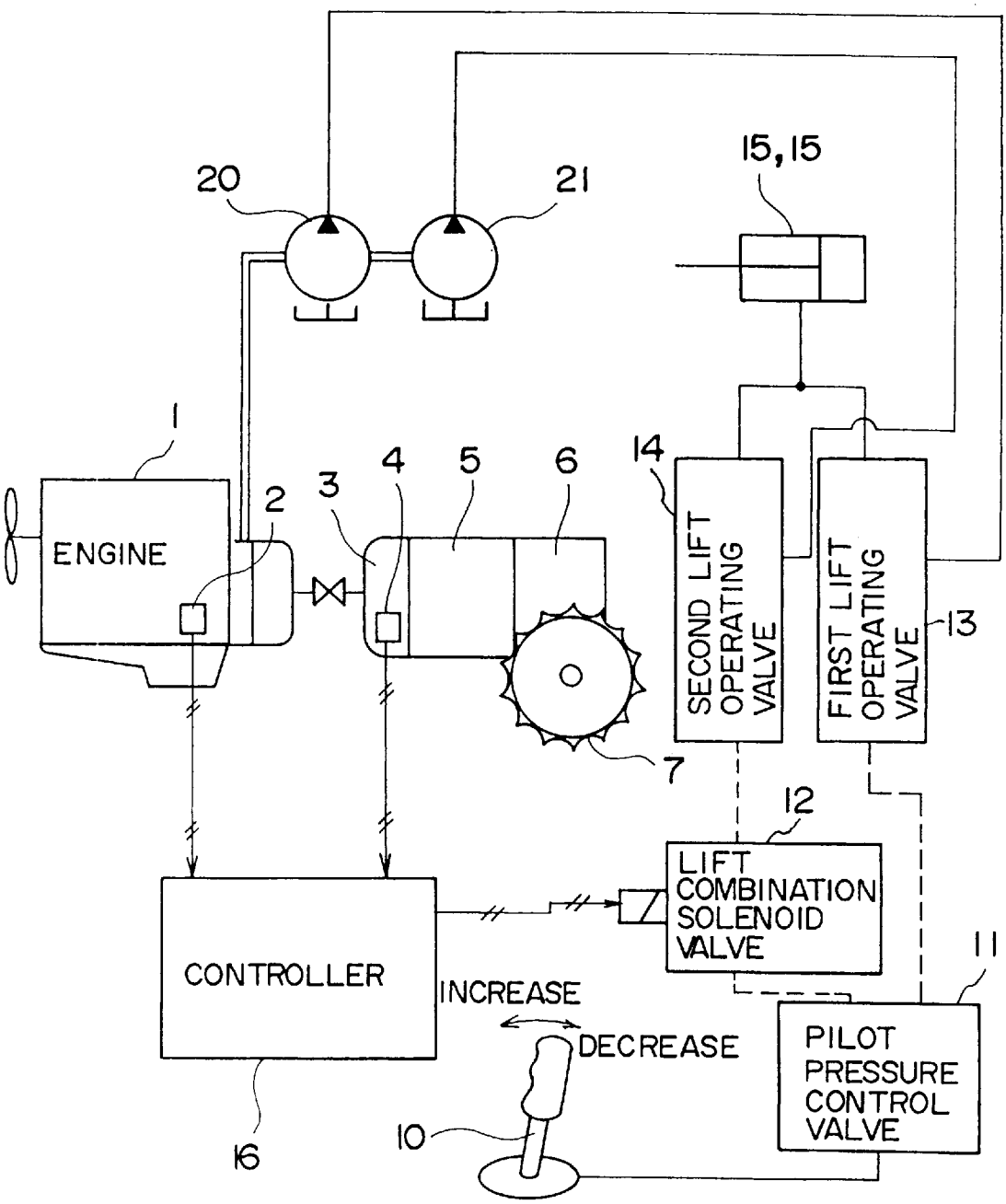
FIG. 1 is a diagram showing the configuration of a controller according to the present invention.

In FIG. 1, an engine 1 is provided with an engine rotational speed sensor 2; and a torque converter 3 is provided with a revolutional speed sensor 4 for detecting the number of revolutions per minute of an output shaft.

A transmission 5, made integral with the torque converter 3, is provided with a final speed reducer 6 which has a sprocket 7.

A lift operating lever 10 for operating a blade, which is not shown, is connected to a pilot pressure control valve 11; pilot lines of the pilot pressure control valve 11 are respectively connected to a first lift operating valve 13 and a second lift operating valve 14. A lift combination solenoid valve 12 is installed in the pilot line which connects the pilot pressure control valve 11 and the second lift operating valve 14.

Lift cylinders 15, 15 are respectively connected to hydraulic pumps 20, 21 via the first lift operating valve 13 and the second lift operating valve 14.

A controller 16 is connected to the revolutional speed sensor 2 of the engine 1 and to the output shaft revolutional speed sensor 4 of the torque converter 3 to receive signals; it is also connected to the lift combination solenoid valve 12 to issue control signals.

Figure 2:
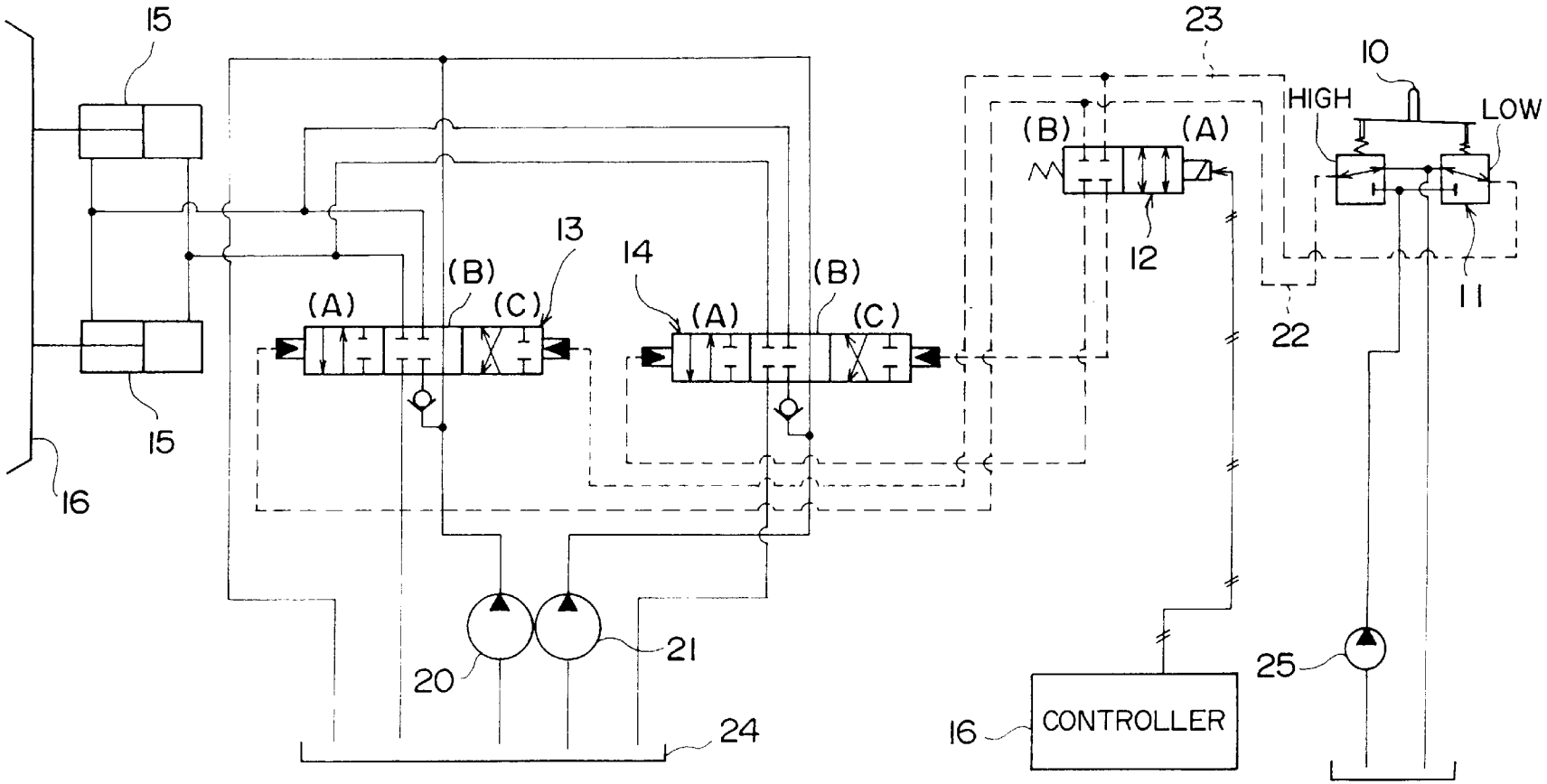
FIG. 2 is a hydraulic control circuit diagram of the controller according to the present invention.
Figure 3:
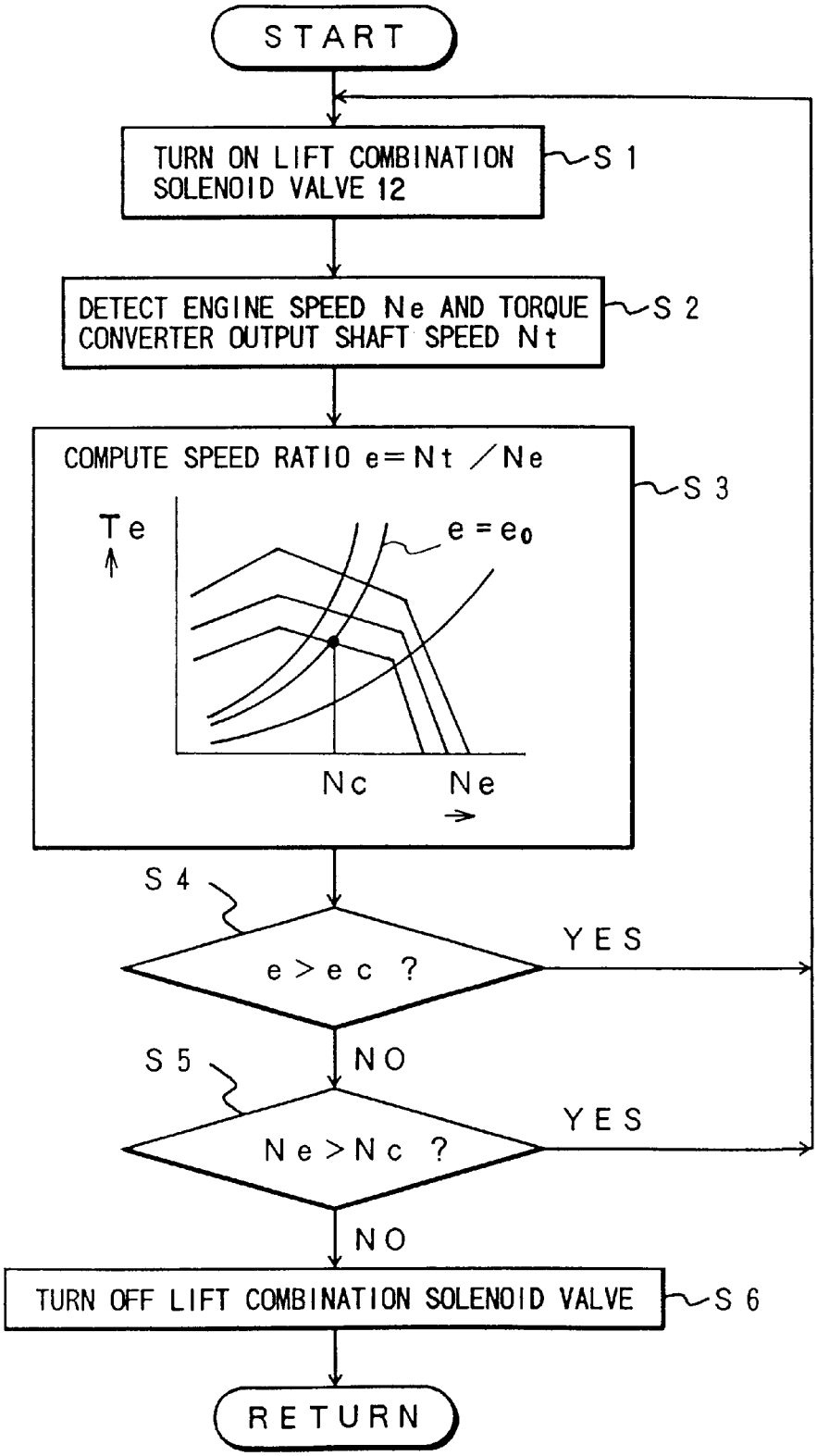
FIG. 3 is a flowchart illustrating a control method according to the present invention.
Figure 4:
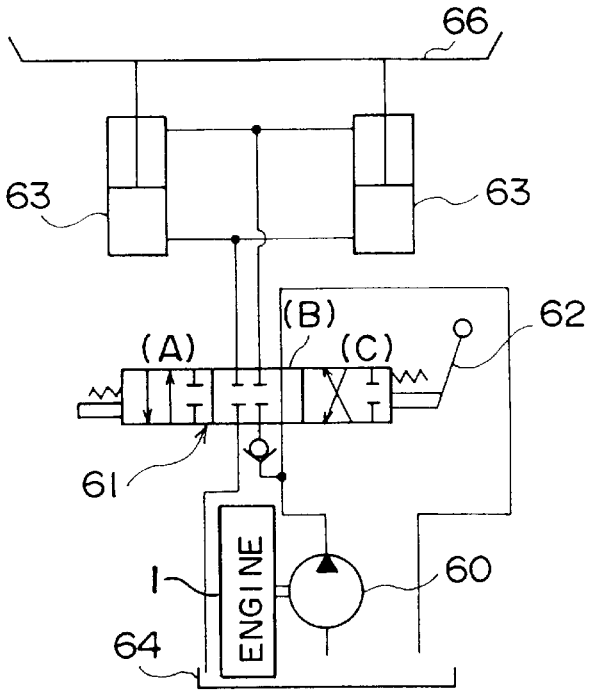
FIG. 4 PRIOR ART
FIG. 4 is a hydraulic circuit diagram illustrating an example of the blade lifting operation of a conventional bulldozer.
Figure 5:
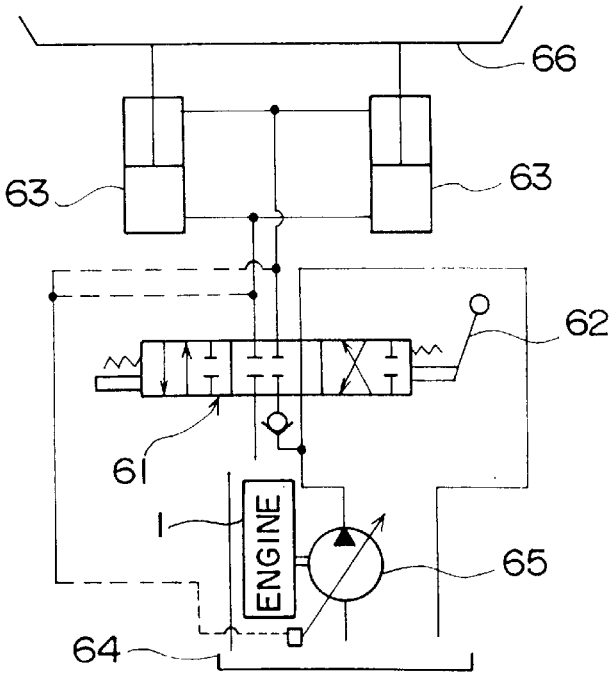
FIG. 5 PRIOR ART
FIG. 5 is a hydraulic circuit diagram illustrating another example of the blade lifting operation of the conventional bulldozer.

FIG. 2 is a hydraulic circuit diagram of the apparatus; a discharge line of the first hydraulic pump 20 is connected to the lift cylinders 15, 15 via the first lift operating valve 13. The discharge line of the second hydraulic pump 21 is connected to the second lift operating valve 14 and connected to the lift cylinders 15, 15.

Pilot hydraulic lines 22 and 23, respectively connected to the high position and to the low position of the pilot pressure control valve 11 having the lift operating lever 10, are connected to the first lift operating valve 13 and also connected to the second lift operating valve 14 via the lift combination solenoid valve 12. The lift combination solenoid valve 12 is also connected to the controller 16 by an electric circuit. Further, the return (drain) lines of the first hydraulic pump 20 and the second hydraulic pump 21 are provided with an oil tank 24.

A control signal is issued from the controller 16 to the lift combination solenoid valve 12 to set the lift combination solenoid valve 12 to its position (A) (ON). When the lift operating lever 10 is operated to set the pilot pressure control valve 11 to the high position, the pilot pressure of the pilot hydraulic pump 25 is supplied to the first lift operating valve 13 and the second lift operating valve 14, and each of the first lift operating valve 13 and the second lift operating valve 14 is set to its position (A) (ON). This causes the discharged oil of the first hydraulic pump 20 and the second hydraulic pump 21 to be combined before it is supplied to the respective lift cylinders 15, 15 to contract the respective lift cylinders 15, 15 and move the blade 16 upwardly.

Conversely, when the lift operating lever 10 is operated to set the pilot pressure control valve 11 to the low position, each of the first lift operating valve 13 and the second lift operating valve 14 is set to its position (C) (ON). This causes the discharged oil of the first hydraulic pump 20 and the second hydraulic pump 21 to be combined before it is supplied to the respective lift cylinders 15, 15 to extend the respective lift cylinders 15, 15 and move the blade downwardly.

Then, when no control signal is sent from the controller 16 to the lift combination solenoid valve 12, the lift combination solenoid valve 12 is switched from its position (A) (ON) to its position (B) (OFF). Therefore, even if the lift operating lever 10 is operated to set the pilot pressure control valve 11 to the high position or the low position, the pilot pressure of the pilot hydraulic pump 25 is not supplied to the second lift operating valve 14 although it is supplied to the first lift operating valve 13. This means that only the first lift operating valve 13 is set to its position (A) (ON) or its position (C) (ON), whereas the second lift operating valve 14 remains in its position (B) (OFF).

Hence, only the discharged oil of the first hydraulic pump 20 is sent to the lift cylinders 15, 15, whereas the discharged oil of the second hydraulic pump 21 returns to the oil tank 24. Therefore, the lifting and lowering speed of the blade 16 is decreased and the consumed horsepower of the engine 1 is reduced to half. The extra horsepower resulting from the reduction of the horsepower consumed by the working system is used by the traveling system, thereby enabling the tractive output to be increased.

The tractive force control method will now be described in conjunction with the flowchart of FIG. 3.

At the time of starting the work (START), a control signal is issued from the controller 16 in step SI to set the lift combination solenoid valve 12 to its position (A) (ON). This operation to set the valve 12 to its ON position causes the discharged oil of the first hydraulic pump 20 and the second hydraulic pump 21 to be combined; therefore, the respective lift cylinders 15, 15 operate promptly.

In step S2, the engine rotational speed sensor 2 detects engine rotational speed Ne, while the torque converter output shaft revolutional speed sensor 4 detects the rotational speed Nt of the output shaft of the torque converter. The signals representing the engine rotational speed Ne and the rotational speed Nt of the output shaft of the torque converter are received by the controller 16.

In step S3, the controller 16 computes the speed ratio e (=Nt/Ne).

In step S4, the controller 16 determines whether the computed speed ratio e is larger than the target speed ratio ec, that is, whether e>ec.

The value of the target speed ratio ec is fixed as follows with respect to the speed ratio eo observed when the torque converter 3 is stalled:

ec>eo

If the result of the determination of whether the speed ratio e>the target speed ratio ec is YES, then it means that the torque converter 3 has a sufficient allowance against a stall; therefore, the controller goes back to step S1.

If the result of the determination of whether the speed ratio e>the target speed ratio ec is NO, then it means that the allowance against a stall is running out; therefore, the controller determines in step S5 whether the engine rotational speed Ne is higher than the preset speed Nc, that is, Ne>Nc.

If the result of the determination of whether the engine rotational speed Ne>the preset speed Nc is YES, then it means that the tractive output has an allowance with respect to the preset target value; therefore, the controller goes back to step S1. The value of the preset speed Nc is different from that of the speed Nf at which the torque converter 3 is stalled.

When the speed ratio and the engine rotational speed Ne have been obtained, the engine output shaft torque Te is determined from a matching curve (see the chart shown in step S3) of the engine 1 and the torque converter 3, so that the tractive output can be obtained.

In step 15, if the result of the determination of whether the engine rotational speed Ne>the preset speed Nc is NO, then it means that the tractive output is smaller than the predetermined target value and the torque converter 3 is stalled.

Therefore, in step S6, the lift combination solenoid valve 12 is switched to its position (B) (OFF) by not sending control signal from the controller 16. This causes the discharged oil of the second hydraulic pump 21 to go back to the oil tank 24 while the second lift operating valve 14 remains in its position (B) (OFF). Thus, the load of the engine 1 with respect to the lift cylinders 15, 15 is reduced, so that more engine output can be distributed to the torque converter 3 accordingly to increase the tractive output. Then, the controller goes back to step S2 (RETURN) to repeat the aforesaid respective steps until predetermined work is finished.

INDUSTRIAL APPLICABILITY

The present invention reduces the engine load for driving a hydraulic pump of a working machine system when the tractive output of the vehicle falls below a predetermined target value in order to increase the engine output distributed to the traveling system, thereby preventing a torque converter from being stalled. When the tractive output exceeds the predetermined target value, sufficient engine output is distributed to the working machine system to enable prompt operation of the blade so as to improve workability. The present invention is useful as the tractive force control apparatus and method for a construction equipment vehicle.

What is claimed is:

1. A tractive force control apparatus for a construction equipment vehicle, which apparatus distributes the output of an engine to a working machine system for driving a plurality of hydraulic pumps to operate a working machine and to a traveling system for traveling the vehicle by driving a sprocket via a power line constituted by a torque converter, a transmission, and a final speed reducer; said tractive force control apparatus comprising:

an engine rotation speed sensor for detecting the speed of said engine; a torque converter output shaft rotational speed sensor for detecting the output shaft speed of said torque converter; and a controller which compares speed ratio e(=Nt/Ne), which is computed from an engine rotational speed Ne detected by the engine rotational speed sensor and a rotational speed Nt of the output shaft of the torque converter detected by the torque converter output shaft rotational speed sensor, with target speed ratio ec, and if e≦ec, then it controls a lift operating valve, provided in a hydraulic circuit of the working machine system, so that the discharge of one hydraulic pump is returned to an oil tank.

2. A tractive force control apparatus for a construction equipment vehicle according to claim 1, wherein said controller is provided with a lift combination solenoid valve between itself and the lift operating valve, and it switches the lift combination solenoid valve from ON to OFF to control the lift operating valve so as to return the discharge of the hydraulic pump to the oil tank.

3. A tractive force control method for a construction equipment vehicle, whereby the output of an engine is distributed to a working machine system for driving a plurality of hydraulic pumps to operate a working machine and to a traveling system for traveling the vehicle by driving a sprocket via a power line constituted by a torque converter, a transmission, and a final speed reducer, said method comprising the steps of;

discharging one hydraulic pump of the working machine system to an oil tank, if the tractive output of the traveling system is smaller than a predetermined target value, to reduce the load on the working machine so as to increase the tractive output; or stopping the return of the discharge of the hydraulic pump of the working machine, if the tractive output is larger than the predetermined target value, to permit prompt operation of the working machine.

4. A tractive force control method for a construction equipment vehicle according to claim 3, further comprising the steps of;

computing a speed ratio e(=Nt/Ne), which is computed from an engine rotational speed Ne of said engine and a rotational speed Nt of the output shaft of the torque converter and comparing the speed ratio with a target speed ratio ec, and if $e \leqq ec$, then controlling the lift operating valve provided in the hydraulic circuit of the working machine system to return the discharge of the hydraulic pump to the oil tank; or if $e > ec$, then controlling the lift operating valve of the working machine system to stop the return of the discharge of the hydraulic pump.

5. A construction equipment vehicle comprising:

an engine;

a plurality of hydraulic pumps which are driven by a portion of an output of said engine;

a working machine system having a working machine which can be driven either by one of said hydraulic pumps or by at least two of said hydraulic pumps, said working machine system including a hydraulic circuit containing an operating valve;

a traveling system which is driven by a portion of the output of said engine for traveling the vehicle; and a tractive force control apparatus for distributing the output of said engine to the plurality of hydraulic pumps and to the traveling system, wherein if a tractive output of the traveling system is smaller than a predetermined target value, said tractive force control apparatus reduces a load on one of said hydraulic pumps so as to increase the tractive output.

6. A construction equipment vehicle in accordance with claim 5, wherein said tractive force control apparatus reduces the load on said one of said hydraulic pumps by passing a discharge output of that hydraulic pump to an oil tank without going to said working machine.

7. A construction equipment vehicle in accordance with claim 5, wherein said tractive force control apparatus actuates said operating valve to reduce the load on said one of said hydraulic pumps, by passing a discharge output of that hydraulic pump to an oil tank without going to said working machine.

8. A construction equipment vehicle in accordance with claim 5, wherein if a tractive output of the traveling system is larger than a predetermined target value, said tractive force control apparatus actuates said operating valve to pass a discharge output of a hydraulic pump, which can drive said working machine system, to said working machine to permit prompt operation of said working machine.

9. A construction equipment vehicle comprising:

an engine;

a first hydraulic pump which is driven by a portion of an output of said engine;

a second hydraulic pump which is driven by a portion of an output of said engine;

a working machine system having a working machine which can be driven either by one of said first and second hydraulic pumps or by both of said first and second hydraulic pumps, said working machine system including a hydraulic circuit containing a first operating valve connected between said first hydraulic pump and said working machine and a second operating valve connected between said second hydraulic pump and said working machine;

a traveling system which is driven by a portion of the output of said engine for traveling the vehicle; and a tractive force control apparatus for distributing the output of said engine to the first and second hydraulic pumps and to the traveling system, wherein if a tractive output of the traveling system is smaller than a predetermined target value, said tractive force control apparatus reduces a load on said second hydraulic pump so as to increase the tractive output.

10. A construction equipment vehicle in accordance with claim 9, wherein said tractive force control apparatus actuates said operating valve to reduce the load on said second hydraulic pump by passing a discharge output of said second hydraulic pump to an oil tank without going to said working machine.

11. A construction equipment vehicle in accordance with claim 9, further comprising a combination valve having a first position and a second position, wherein said combination solenoid valve is controlled by a controller, wherein said combination solenoid valve in its first position permits actuation signals to be applied to said second operating valve to position said second operating valve in an ON position to pass discharge of said second hydraulic pump to said working machine, and wherein said combination solenoid valve in its second position prevents application of actuation signals to said second operating valve so that said second operating valve is positioned in its OFF position to pass discharge of said second hydraulic pump to an oil tank without going to the working machine.

12. A construction equipment vehicle comprising:

an engine;

a plurality of hydraulic pumps which are driven by a portion of an output of said engine;

a working machine system having a working machine which can be driven either by one of said hydraulic pumps or by at least two of said hydraulic pumps, said working machine system including a hydraulic circuit containing an operating valve;

a traveling system which is driven by a portion of the output of said engine for traveling the vehicle, said traveling system including a torque converter, a transmission, a final speed reducer, and a driving sprocket, wherein said torque converter has an output shaft; and a tractive force control apparatus for distributing the output of said engine to the plurality of hydraulic pumps and to the traveling system, said tractive force control apparatus comprising:

an engine rotational speed sensor for detecting a rotational speed Ne of said engine;

a torque converter output shaft rotational speed sensor for detecting a rotational speed Nt of the output shaft of said torque converter; and a controller which utilizes the engine rotational speed Ne, which is detected by the engine rotational speed sensor, and the rotational speed Nt of the output shaft of the torque converter, which is detected by the torque converter output shaft rotational speed sensor, to compute a speed ratio e, and which compares the thus computed speed ratio e with a target speed ratio ec, wherein if e≦ec, said controller controls said operating valve to reduce a load on a first one of the hydraulic pumps which can drive said working machine system, so as to increase the portion of the engine output distributed to the traveling system.

13. A construction equipment vehicle in accordance with claim 12, wherein if e>ec, said controller controls said operating valve so that a discharge output of said first one of the hydraulic pumps which can drive said working machine system is transmitted to said working machine.

14. A construction equipment vehicle in accordance with claim 12, wherein if e≦ec, said controller controls said operating valve so that a discharge output of said first one of said hydraulic pumps which can drive said working machine system is returned to an oil tank without going to said working machine.

15. A construction equipment vehicle in accordance with claim 14, wherein if e>ec, said controller controls said operating valve so that a discharge output of said first one of said hydraulic pumps which can drive said working machine system is transmitted to said working machine.

16. A construction equipment vehicle in accordance with claim 12, wherein a combination solenoid valve is located between said controller and the operating valve, wherein said combination solenoid valve is controlled by said controller and has a first position and a second position, wherein said combination solenoid valve in its first position permits actuation signals to be applied to said operating valve to position said operating valve in an ON position to pass discharge of said first one of said hydraulic pumps to said working machine, and wherein said combination solenoid valve in its second position prevents application of actuation signals to said operating valve so that said operating valve is positioned in its OFF position to pass discharge of said first one of said hydraulic pumps to an oil tank without going to the working machine.

17. A construction equipment vehicle in accordance with claim 12, wherein said construction equipment vehicle is a bulldozer, wherein said working machine comprises a bulldozer blade, and wherein said operating valve controls raising and lowering of said blade.

18. A construction equipment vehicle in accordance with claim 12, wherein said computed speed ratio e=Nt/Ne.

19. A method for controlling tractive force of a construction equipment vehicle, wherein said vehicle includes an engine, a working machine, a traveling system, and first and second hydraulic pumps to operate the working machine; said method comprising the steps of:

applying a portion of an output of said engine to drive said first and second hydraulic pumps and another portion of the output of said engine to the traveling system for traveling the vehicle;

if a tractive output of the traveling system is larger than a predetermined target value, passing an output of each of said first and second hydraulic pumps to said working machine; and if a tractive output of the traveling system is smaller than the predetermined target value, reducing a load on one of said first and second hydraulic pumps so as to increase the tractive output.

20. A method in accordance with claim 19, wherein the step of reducing a load comprises returning the output of the second hydraulic pump to an oil tank without passing to said working machine.

21. A method in accordance with claim 20, wherein said traveling system includes a torque converter, a transmission, a final speed reducer, and a driving sprocket, wherein said torque converter has an output shaft; and wherein said method further comprises the steps of:

determining a rotational speed of said engine;

determining a rotational speed of said output shaft;

determining the tractive output of the traveling system from the thus determined rotational speed of said engine and the thus determined rotational speed of said output shaft; and comparing the thus determined tractive output with the predetermined target value.

* * * * *

UNITED STATES PATENT AND TRADEMARK OFFICE

CERTIFICATE OF CORRECTION

PATENT NO. : 5,983,151
DATED : November 9, 1999
INVENTOR(S) : Toshikazu Okada et al.

It is certified that error appears in the above-identified patent and that said Letters Patent is hereby corrected as shown below:

Front Page [75]
Inventors, the second line, after "Hirakata", insert -- shi --;
Inventors, the third line, after "Namiki,", delete "Kyoto" and insert -- Tanabe-cyo --;
Inventors, the fourth line, after "Hirakata", insert -- shi --.

Front Page [57]
Abstract, line 4, after "machine", insert -- is presented --;
Abstract, line 14, delete "control apparatus" and insert -- controller --.

Column 1,
Line 38, after "excavate", insert -- the --.

Column 2,
Line 56, delete "1", and insert -- 21 --.

Column 3,
Line 44, delete the second instance of "a", and insert --an--;
Line 45, delete "controller", and insert --apparatus--;
Line 47, delete "controller", and insert -- apparatus --.

Column 4,
Line 57, after "blade", insert -- 16 --.

Column 7
Line 14, delete "the", and insert -- a --.

UNITED STATES PATENT AND TRADEMARK OFFICE

CERTIFICATE OF CORRECTION

PATENT NO. : 5,983,151
DATED : November 9, 1999
INVENTOR(S) : Toshikauzu Okada et al.

It is certified that error appears in the above-identified patent and that said Letters Patent is hereby corrected as shown below:

Column 8,
Line 23, after "combination", insert -- solenoid --.
Line 25, delete "controller", and insert -- tractive force control apparatus --.

Signed and Sealed this

Thirty-first Day of July, 2001

Nicholas P. Godici

*Attest:*

*Attesting Officer*

NICHOLAS P. GODICI
*Acting Director of the United States Patent and Trademark Office*